US007159798B2

(12) United States Patent
Carta

(10) Patent No.: US 7,159,798 B2
(45) Date of Patent: Jan. 9, 2007

(54) SPRAY HEAD FOR A SQUEEZE BOTTLE

(75) Inventor: Lamberto Carta, Pescara (IT)
(73) Assignee: EMSAR S.p.A., San Giovanni Teatino (IT)

( * ) Notice: Subject to any disclaimer, the term of this patent is extended or adjusted under 35 U.S.C. 154(b) by 0 days.
(21) Appl. No.: 10/540,134
(22) PCT Filed: Feb. 5, 2004
(86) PCT No.: PCT/IT2004/000040

§ 371 (c)(1),
(2), (4) Date: Jun. 21, 2005
(87) PCT Pub. No.: WO2004/069421

PCT Pub. Date: Aug. 19, 2004
(65) Prior Publication Data

US 2006/0038039 A1 Feb. 23, 2006
(30) Foreign Application Priority Data

Feb. 10, 2003 (IT) ..... RM2003A0055
(51) Int. Cl.
*B05B 7/06* (2006.01)
*B05B 7/26* (2006.01)
*B65D 1/32* (2006.01)
*B65D 37/00* (2006.01)
(52) U.S. Cl. ..... 239/424; 239/327; 239/314; 239/418; 239/423; 222/206
(58) Field of Classification Search ..... 239/327, 239/314, 418, 423, 424, 103, 302–304, 306, 239/311, 328, 338, 356, 362, 363, 398, 597, 239/600; 222/206, 212–215, 145.5
See application file for complete search history.

(56) References Cited

U.S. PATENT DOCUMENTS 2,796,294 A * 6/1957 McKinnon ..... 239/327
3,392,886 A * 7/1968 Albert et al. ..... 222/212
4,186,882 A * 2/1980 Szczepanski ..... 239/327
5,115,981 A * 5/1992 Callahan et al. ..... 239/402
5,156,307 A * 10/1992 Callahan et al. ..... 222/190
5,318,205 A * 6/1994 Delaney, Jr. ..... 222/211
6,050,504 A * 4/2000 Schultz et al. ..... 239/327
6,267,304 B1 7/2001 Schultz
6,398,133 B1 * 6/2002 Schultz ..... 239/327

FOREIGN PATENT DOCUMENTS

| | | |
|---|---|---|
| CH | 273 817 | 2/1951 |
| FR | 2 411 637 | 7/1979 |
| WO | WO 02/11895 | 2/2002 |

* cited by examiner

*Primary Examiner*—David A. Scherbel
*Assistant Examiner*—Darren Gorman
(74) *Attorney, Agent, or Firm*—Young & Thompson

(57) ABSTRACT

A nebulising dispenser head (1; 100) for a bottle that is elastically deformable by squeezing, comprising a channel of the liquid and a channel of the air obtained in a machine block of the dispenser head (1; 100) and an ejection tip (3) provided with a sealing door (8) hinged in its distal part (35), the sealing door (8) being able to rotate by 180 DEG from an open position to a closed position of a discharge orifice of the dispenser head.

12 Claims, 2 Drawing Sheets

SPRAY HEAD FOR A SQUEEZE BOTTLE

TECHNICAL FIELD

The present invention relates to a nebulising dispenser head for a bottle that is elastically deformable by squeezing, in which a jet of a liquid, contained inside the bottle under a volume of air, is nebulised by being mixed with part of said volume of air when both fluids, air and liquid, are expelled simultaneously through the dispenser head by effect of the internal pressure generated by the manual squeezing of the bottle.

A dispenser head of this kind is a valid alternative to dispenser heads with micro-pump and to dispenser heads for pressurised containers, with respect to the former thanks to its lower cost as a result of a simpler construction, and with respect to the latter thanks to its reduced environmental impact, not requiring a gas bottle with the related pressurised gas.

As mentioned above, in dispenser heads for deformable bottle the energy needed for the nebulisation is provided to the fluid through the squeezing of the bottle whereon the dispenser head is applied. To allow an adequate nebulisation, generally the dispenser head has a channel of the liquid, which on one side is connected to a suction tube which draws from the bottom of the bottle and on the other side ends with a nozzle of the liquid in a mixing chamber in which the jet of liquid is hit by an air current flowing from a channel communicating with the volume of air inside the bottle, air channel that surrounds the liquid channel and ends, like that one, in the mixing chamber upstream of an orifice for the discharge of the nebulised to the exterior.

To prevent the undesired spillage of the liquid, if the bottle is upset or squeezed involuntarily, and also to avoid the possible deterioration of the liquid in contact with the outside air, means for closing the dispenser head have already been provided.

BACKGROUND ART

Some closing means act directly on the output orifice, such as, among others, in the U.S. Pat. No. 4,186,882 granted 5 Feb. 1980. It provides a liquid nebuliser comprising a liquid channel ending with a nozzle surrounded by the neck of the bottle in which the inflow of air takes place, a mixing chamber obtained with a closure element applied on the neck of the bottle and provided with an orifice discharging to the exterior.

Although the screw-on cap is currently used on bottles for widely distributed products, is nonetheless inconvenient: to use the product contained in the bottle, the cap must be unscrewed, set down some place and, once its use is complete, the cap must be picked up again and screwed back on.

To overcome this drawback, which entails time wastage and the risk of forgetting to close the bottle, bottles with nebulising dispenser heads which can be closed with a manually actuated valve have already been studied.

For example, the U.S. Pat. No. 6,267,304 granted on 31 Jul. 2001, discloses a nebulising dispenser head, in which a sprayer body defining a valve seat with a valve which defines a passage of liquid, one and the other being able to be rotated selectively about their longitudinal axis between a closed position and an open position of the valve in which the mixing chamber is disconnected from a suction tube and respectively connected thereto; a passage of the air, positioned coaxially around a portion of the passage of the liquid and connecting the interior of the bottle containing a volume of air and said mixing chamber, being closed by the rotation of the valve.

The U.S. Pat. No. 6,398,133, granted on 4 Jun. 2002, discloses a nebulising dispenser head for a bottle to be squeezed, in which a sprayer body defining a valve seat with valve, the valve, which defines the converging conduits of liquid and air, being slidably movable along its own longitudinal axis between a backward closed position and a forward open position, in which the passages of the air and of the liquid are both, respectively, closed and open.

Although the aforementioned patents effectively solve the problem of closing the nebulising dispenser head of a bottle that is elastically deformable in manual fashion, they achieve this result thanks to valves which make their construction more complex and costly. Moreover the rotary operation of a valve is inconvenient and does not facilitate use because it does not allow clearly to show the opened and closed state of the valve. Similarly, in the case of the sliding valve, since the sliding travel is very limited, the exact position of the valve is not perfectly clear.

DISCLOSURE OF INVENTION

Therefore, an object of the present invention is to obtain means for closing a nebulising dispenser head for a squeezable bottle with a simple and inexpensive structure.

Another object of the invention is to provide means for closing a nebulising dispenser head for a squeezable bottle whose is use is easy and intuitive.

An additional object of the invention is to provide means for closing a nebulising dispenser head for a squeezable bottle which clearly highlight to the user its closed or opened state.

Yet another object of the invention is to provide means for closing a nebulising dispenser head for a squeezable bottle that does not entail any waste of time in the use of the bottle.

The aforementioned objects are achieved by a nebulising dispenser head for a bottle that can be elastically deformable by squeezing, comprising a channel for the liquid, connected at one of its ends to a suction tube which draws a liquid contained inside a bottle under a volume of air and terminating, at its other end, with a nozzle for the liquid in a mixing chamber, and a channel for the air communicating with said volume of air of the bottle, surrounding the channel of the liquid and merging with said mixing chamber obtained by coupling with a terminal element which is applied facing said nozzle for the liquid and is provided with an outwardly discharging nozzle, nebulising dispenser head which, from a general point of view, is characterised in that:

- said channel for the liquid and said channel for air are obtained in a machined block of said dispenser head in the form of a tubular segment externally provided with ribs and, respectively, of a wall surrounding said channel for the liquid with the formation of a tubular compartment, substantially coaxial to said ribbed tubular segment, said wall having an opening communicating with said volume of air inside the bottle;
- said terminal element includes an ejection tip with tubular element having a cavity that is contoured so it axially narrows outwards in said discharge orifice and it ends with a diverging segment, said ejection tip being inserted with a proximal portion thereof into said ribbed tubular compartment to form said mixing chamber;
- externally coaxial to said tubular element being integrally formed a sleeve provided with an abutment able to define a depth of insertion of said ejection tip into said tubular segment of the machined block;

a sealing door being integrally hinged in a distal part of said sleeve, the sealing door being able to rotate by 180° from an open position to a closed position of said discharge orifice.

DESCRIPTION OF THE DRAWINGS

The invention shall be more readily apparent from the detailed description that follows of an embodiment thereof, in two variants, considered together with the accompanying drawing, in which.

DESCRIPTION OF THE ILLUSTRATIVE EMBODIMENTS

Figure 2:
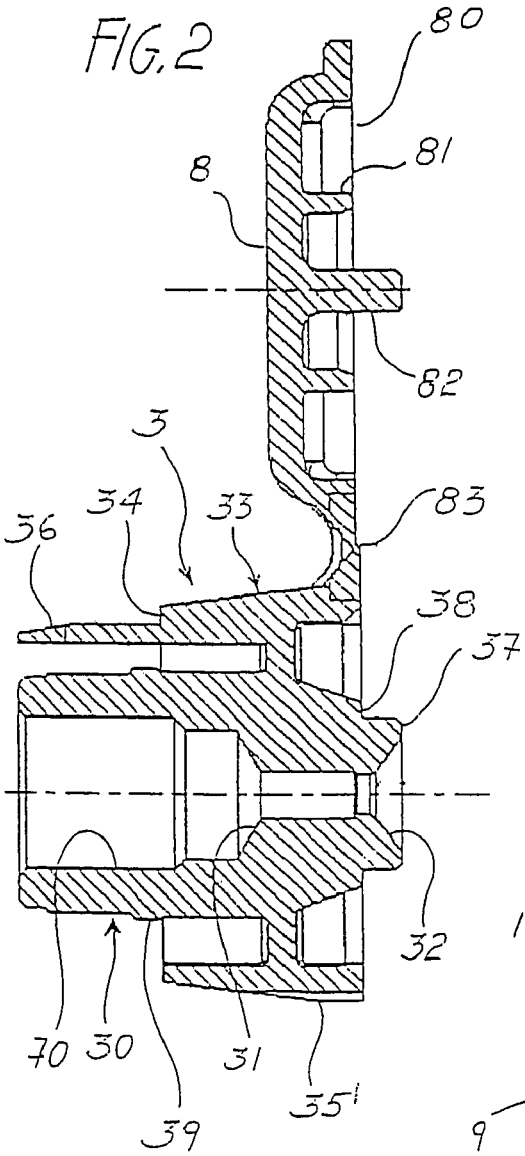
FIG. 2 is a longitudinal section of an ejection tip with dispenser head sealing door according to the invention.
Figure 1:
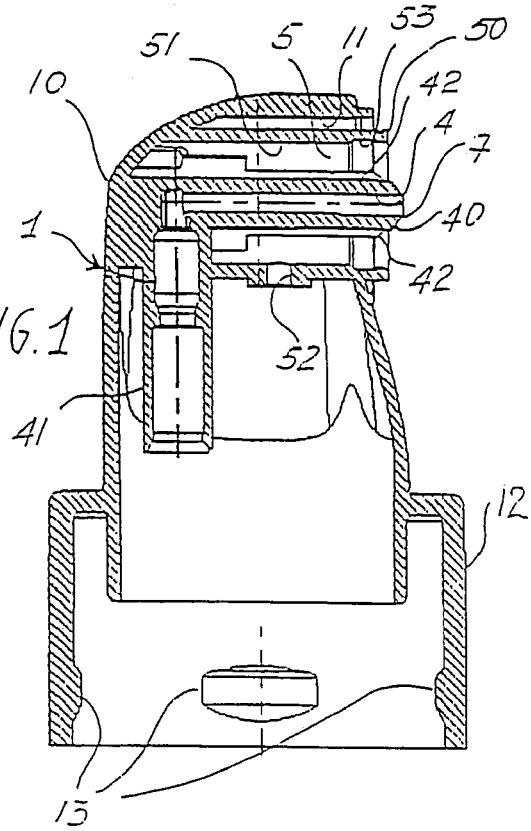
FIG. 1 is a longitudinal section of a first variant of dispenser head, without the ejection tip with sealing door, according to the invention.
Figure 3:
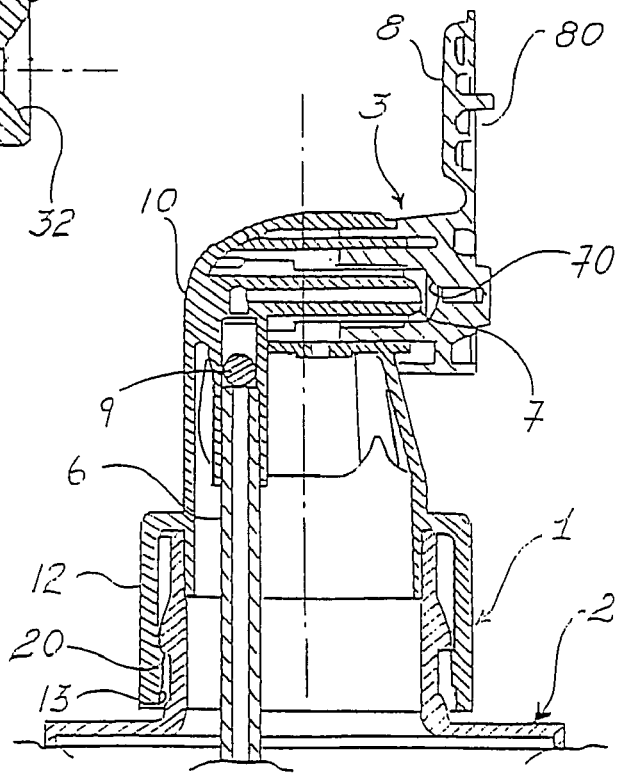
FIG. 3 is a longitudinal section of the dispenser head of FIG. 1, complete with ejection tip with sealing door in the open condition, according to the invention.

With reference initially to FIGS. 1 through 3, which are longitudinal sections, the number 1 designates a dispenser head according to the present invention for a snap-on coupling with a bottle that is elastically deformable by squeezing (shown only partially in FIG. 3). The reference number 3 designates an ejection tip.

According to the invention, the nebulising dispenser head is formed in a single machined block 10, in which are obtained a channel for the liquid 4 and a channel for air 5.

In the figures that follow the channel of the liquid 4 is shown with a horizontal tubular segment 40 following a vertical segment 41 whereon is inserted an end of a suction tube 6, with the interposition of a retaining ball 9. It is known (although it is not shown in the figures) that the suction tube 6 is immersed with its other end in a liquid contained within the bottle 2. The liquid, which is the product to be nebulised, is under a volume of air. The horizontal tubular segment 40 of the channel of the liquid 4 ends, in its free end, with a nozzle of the liquid 7 in a mixing chamber 70. The mixing chamber 70 is formed by applying the ejection tip 3, as shall be described more in detail hereafter.

As shown, the horizontal segment 40 of the channel of the liquid 4 externally has ribs 42 serving reinforcement functions. Moreover, the ribs 42 serve to create air passages for the air channel 5 obtained from the co-operation of a wall 50 surrounding the segment 40 of the liquid channel 4 with the ejection tip 3.

In particular, the wall 50 is cylindrical and it forms a tubular compartment 51 that is substantially coaxial to the ribbed tubular segment 40. Naturally, the wall 50 may have other than cylindrical shape. The wall 50 has an opening 52 in communication with the internal volume of air of the bottle. The air channel 5 surrounds the liquid channel 4 and it merges into the coupling mixing chamber 70 obtained with the ejection tip 3.

The ejection tip 3 has a tubular element 30 with its cavity shaped to axially narrow outwards in a discharge orifice 31 and end with a diverging segment 32.

Externally coaxial to the ejection tip 3 is formed, integrally therewith, a sleeve 33 provided with an abutment 34 able to define a depth of insertion of the ejection tip 3 into the tubular compartment 51.

The ejection tip 3 further comprises a sealing door 8 hinged in the upper part of the sleeve 33, in a distal part 35 thereof. The door is at equilibrium in the open position and it therefore tends spontaneously to complete the last part of the opening rotation of 180° from the closed position.

In particular, the ejection tip 3 has a centring element in the form of a plate 36 projecting from the sleeve 33 and able to be inserted into the machined block 10 of the dispenser head 1 in a slit 11 obtained therein externally to the tubular compartment 51.

The ejection tip 3 has a cylindrical distal end 37 in correspondence with the diverging segment 32 of the discharge orifice 31 forming, at its base, an abutment step 38.

The sealing door 8 has, in its face 80 destined to engage the ejection tip 3, a sealing ring 81 and, coaxially internal thereto, a projecting pivot 82. The sealing ring 81 is destined to abut against the abutment step 38 of the distal end of the ejection tip 3 coupling by interference with the outer profile of the distal end 37 in such a way as to assure tightness. The projecting pivot 82 is able to be inserted into the diverging final segment 32 of the discharge orifice 31 to favour the correct coupling of the parts and also to lock the door in the closed position.

The wall 50 surrounding the liquid channel 4 has, on the surface that faces the tubular segment of the liquid channel, undercut portion s 53, whilst the tubular element 30 of the ejection tip 3 has on its outer surface corresponding projections 39 destined to engage the undercut portions 53.

When, as shown in FIG. 3, the ejection tip 3 is applied to the lock 10 of the dispenser head 1, the tubular element 30 is inserted in the tubular compartment 51 of the air channel 5. With the projections 39 of the tubular element 30 inserted in the undercut portions 53, the cavity of the tubular element 30 creates the mixing chamber 70, facing the nozzle 7 for the liquid.

In FIG. 3, the sealing door 8 is shown rotated upwards around the virtual hinge designated 83 in the connecting area with the distal portion of the sleeve 33. This is the open position. The closed position of the sealing door is shown in FIGS. 4 and 5.

As shown in FIGS. 1 and 3, the dispenser head 1 inferiorly has a tubular snap-on connecting portion 12 internally shaped with protrusions 13 circumferentially equidistant towards the interior, able to engage a peripheral projection 20 of the neck of the bottle 2.

Figure 4:
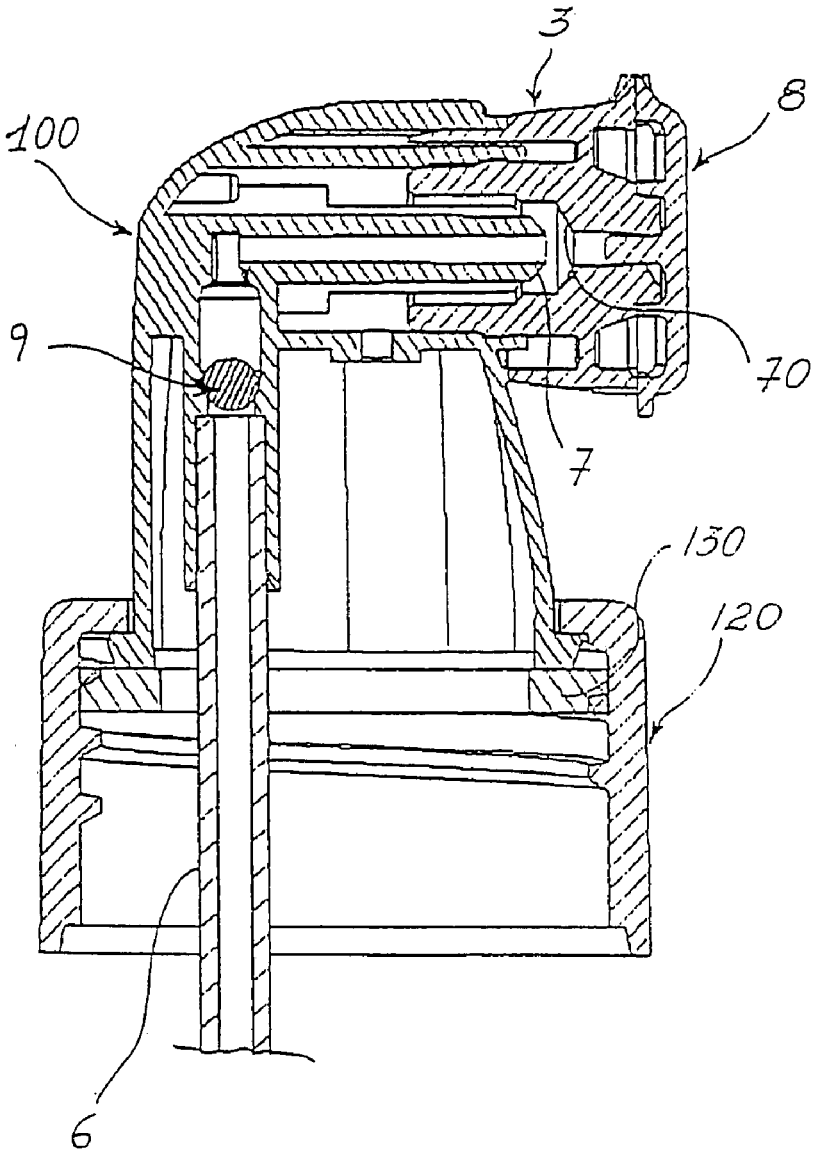
FIG. 4 is a longitudinal section of a second variant of dispenser head, complete with ejection tip with sealing door in the closed state, according to the invention, the dispenser head having a connection with the neck of the bottle.

With reference to FIG. 4, which is a longitudinal section, a dispenser head 100 is shown which differs from the dispenser head 1 of FIGS. 1 and 3 only in its different connection to the neck of the bottle. The dispenser head 100 includes a separate collar 120 internally threaded to be screwed, with the interposition of a gasket 130, onto a bottle neck with matching thread (not shown). The other identical parts, designated by the same reference numbers, are not further described herein.

Figure 5:
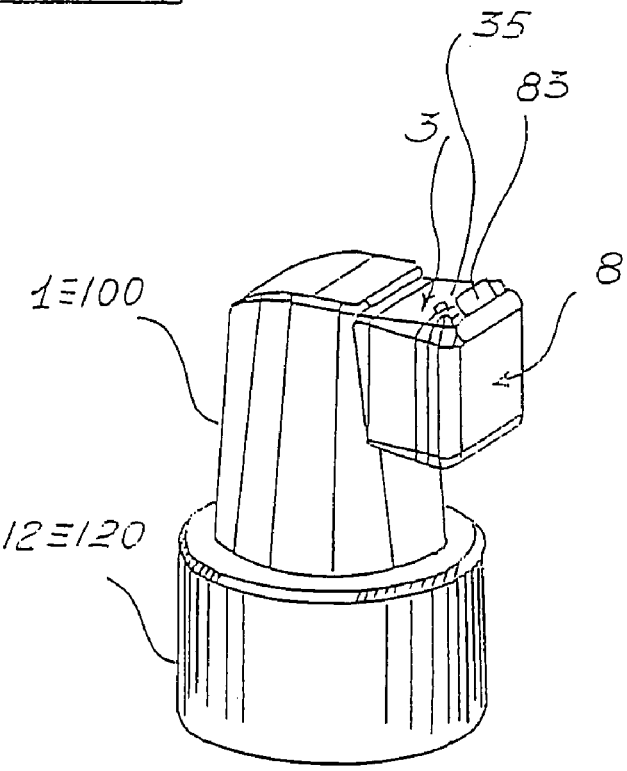
FIG. 5 is a schematic axonometric view of the dispenser head of FIG. 4.

Lastly, FIG. 5 shows an axonometric view of the dispenser head 1 or 100 according to the present invention with the sealing door 8 in the closed position as in FIG. 4.

The invention claimed is:

1. A nebulising dispenser head (1; 100) for a bottle that is elastically deformable by squeezing, comprising:

liquid channel (4) with first and second ends, the liquid channel connected at the first end to a suction tube (6) which draws a liquid contained within the bottle (2) from under a volume of air, and the liquid channel terminating, at the second end, with a liquid nozzle (7) disposed in a mixing chamber (70), the mixing chamber defined by a terminal element facing said nozzle;

an orifice (31) for discharging the liquid outwards from the mixing chamber; and an air channel (5) communicating with said volume of air of the bottle (2), the air channel (5) surrounding the liquid channel (4) and merging into said mixing chamber (70) wherein, said liquid channel (4) and said air channel (5) are formed in a block (10) of said dispenser head (1; 100) as a ribbed tubular segment (40) externally ribbed with ribs (42), said air channel (5) comprises a wall (50) surrounding said liquid channel (4), said wall (50) defines a tubular compartment (51) substantially coaxial to said ribbed tubular segment (40), thereby forming a ribbed tubular compartment, said wall (50) includes an opening (52) for communication with said volume of air of the bottle (2), said terminal element includes an ejection tip (3) with a tubular element (30) having a cavity shaped to axially narrow outwards in said discharge orifice (31) and terminate with a diverging segment (32), said ejection tip (3) is inserted with a proximal portion thereof into said ribbed tubular compartment (51) thereby defining said mixing chamber (70), said ejection tip includes a sleeve (33) externally coaxial to said tubular element (30) and integrally provided with an abutment (34) defining a depth of insertion of the ejection tip into said ribbed tubular compartment (51) of the block (10), and said ejection tip further includes a sealing door (8) integrally hinged at a distal part (35) of said sleeve (33), the sealing door (8) being rotatable by 180° from an open position to a closed position of said discharge orifice (31).

2. A dispenser head (1; 100) as claimed in claim 1, further comprising:

a slit in the block formed externally to said ribbed tubular compartment (10), wherein, the ejection tip (3) has a centering element, the centering element being a plate (36) projecting from said sleeve (33) and being insertable into said slit.

3. A dispenser head (1; 100) as claimed in claim 1, wherein, said ejection tip (3) has a cylindrical distal end (37) in correspondence with the diverging segment (32) of the discharge orifice (31), the distal end (37) comprising an abutment step (38), and said sealing door (8) has a face (80), a sealing ring (81) and, coaxially internal with the sealing ring, a projecting pivot (82), wherein when the sealing door (8) is rotated to the closed position, the face (80) engages with the ejection tip, the sealing ring (81) abuts against the abutment step (38), and the projecting pivot (82) enters said diverging segment (32) of the discharge orifice (31) to lock the sealing door (8) in the closed position.

4. A dispenser head (1; 100) as claimed in claim 1, wherein, said wall (50) surrounding the liquid channel (4) has, on a surface oriented towards the tubular segment (40) of the liquid channel (4), undercut portions (53), and said tubular element (30) of the ejection tip (3) has an outer surface with corresponding projections (39), in use, engaging said undercut portions (53).

5. A dispenser head (1) as claimed in claim 1, further comprising:

a snap-on tubular portion for snap-on connection (12), the snap-on tubular portion internally shaped with circumferentially equidistant protrusions (13) able to engage a peripheral projection (20) of a neck of the bottle (2).

6. A dispenser head (100) as claimed in claim 1, further comprising:

a gasket (130); and a separate collar (120) internally threaded to be screwed, with interposition of the gasket (130), onto a bottle neck with a matching thread.

7. A nebulising dispenser head for use with a bottle containing a liquid and a volume of air, comprising:

a liquid channel (4) with first and second ends;

a suction tube (6) connected to the first end, in use the suction tube (6) to draw the liquid contained within the bottle (2) from under the volume of air;

a liquid nozzle with a mixing chamber (70) connected to the second end;

a terminal element facing said nozzle;

an orifice (31), in use discharging the liquid outwards from the mixing chamber;

an air channel (5) communicating with said volume of air of the bottle (2), the air channel (5) surrounding the liquid channel (4), said liquid channel (4) being formed as an externally ribbed tubular segment (40), said air channel comprising a wall (50) surrounding said liquid channel (4), said wall (50) defining a tubular compartment (51) substantially coaxial to said ribbed tubular segment (40), thereby forming a ribbed tubular compartment, said wall (50) having an opening (52), in use, for communication with said volume of air of the bottle (2), said terminal element including an ejection tip (3) with a tubular element (30) having a cavity axially narrowing outwards in said discharge orifice (31) and terminating with a diverging segment (32), said ejection tip (3) inserted with a proximal portion into said ribbed tubular compartment (51), said ejection tip including a sleeve (33) externally coaxial to said tubular element (30) and integrally provided with an abutment (34) defining depth of insertion of the ejection tip into said ribbed tubular compartment (51), and said ejection tip further including a sealing door (8) integrally hinged at a distal part (35) of said sleeve (33), the sealing door (8) being rotatable from an open position to a closed position of said discharge orifice (31).

8. A dispenser head as claimed in claim 7, wherein, the ejection tip (3) comprises a centering element, the centering element is a plate (36) projecting from said sleeve (33).

9. A dispenser head as claimed in claim 7, wherein, said ejection tip (3) has a cylindrical distal end (37) in correspondence with the diverging segment (32) of the discharge orifice (31), the distal end (37) comprises an abutment step (38), said sealing door (8) has a face (80) engaging with the ejection tip (3), a sealing ring (81) and, coaxially internal with the sealing ring, a projecting pivot (82), the projecting pivot (82) enters said diverging segment (32) of the discharge orifice (31) to lock the sealing door (8) in the closed position.

10. A dispenser head as claimed in claim 7, wherein, said wall (50) surrounding the liquid channel (4) has undercut portions (53) on a surface oriented towards the tubular segment (40) of the liquid channel (4), and said tubular element (30) of the ejection tip (3) has an outer surface with corresponding projections (39), in use, said corresponding projections (39) engaging said undercut portions (53).

11. A dispenser head as claimed in claim 7, further comprising:

a snap-on tubular portion for snap-on connection (12), the snap-on tubular portion internally shaped with circumferentially equidistant protrusions (13), in use, to engage a peripheral projection (20) of a neck of the bottle (2).

12. A dispenser head as claimed in claim 7, further comprising:

a gasket (130); and a collar (120) internally threaded to be screwed, with interposition of the gasket (130), onto a bottle neck with a matching thread.

* * * * *